US008650871B2

(12) United States Patent
Gentile

(10) Patent No.: US 8,650,871 B2
(45) Date of Patent: Feb. 18, 2014

(54) EXTERNAL COMBUSTION ENGINE

(75) Inventor: Davide Gentile, Trieste (IT)

(73) Assignee: Innovative Technological Systems Di Fontana Claudio, Monfalcone (IT)

( * ) Notice: Subject to any disclaimer, the term of this patent is extended or adjusted under 35 U.S.C. 154(b) by 65 days.

(21) Appl. No.: 13/140,827

(22) PCT Filed: Dec. 16, 2009

(86) PCT No.: PCT/IB2009/007787

§ 371 (c)(1),
(2), (4) Date: Jun. 18, 2011

(87) PCT Pub. No.: WO2010/070428

PCT Pub. Date: Jun. 24, 2010

(65) Prior Publication Data

US 2011/0247332 A1 Oct. 13, 2011

(30) Foreign Application Priority Data

Dec. 19, 2008 (IT) ..... UD2008A0266

(51) Int. Cl.
*F01B 29/10* (2006.01)
*F02G 1/04* (2006.01)

(52) U.S. Cl.
USPC ..... 60/518

(58) Field of Classification Search
USPC ..... 60/518; 123/48 A, 48 C
See application file for complete search history.

(56) References Cited

U.S. PATENT DOCUMENTS 1,911,874 A * 5/1933 Barkeij ..... 123/54.7
3,747,433 A * 7/1973 Crowe ..... 74/598
3,849,986 A * 11/1974 Vural ..... 60/537
3,961,563 A * 6/1976 Wagenseil et al. ..... 91/506
4,228,656 A 10/1980 Frosch
4,240,256 A 12/1980 McDougal (Continued)

FOREIGN PATENT DOCUMENTS

DE 2748908 A * 5/1979
DE 4429602 A1 * 2/1996

(Continued)

OTHER PUBLICATIONS

STIC Search of NPL.*

(Continued)

*Primary Examiner* — Thomas Denion
*Assistant Examiner* — Mickey France
(74) *Attorney, Agent, or Firm* — Flaster/Greenberg P.C.

(57) ABSTRACT

An external combustion engine comprising a drive shaft, a first cylinder kinematically connected to the drive shaft, a second cylinder kinematically connected to the drive shaft, and a thermodynamic circuit fluidly connected to both the cylinders, and having at least an expansion chamber and a compression chamber for a heat-carrying fluid, in order to determine the cyclic movement of the first cylinder and the second cylinder. The first cylinder is mounted on a first support frame and the second cylinder is mounted on a second support frame, distinct from and constrained in a mobile manner to the first support frame. Movement means are mechanically connected to the first support frame and/or the second support frame, in order to determine the desired relative movement of the first support frame and the second support frame and to vary the reciprocal kinematic connection phasing of the two cylinders with respect to the drive shaft.

19 Claims, 6 Drawing Sheets

(56) References Cited

U.S. PATENT DOCUMENTS

| | | | | | |
|---|---|---|---|---|---|
| 4,434,618 | A | * | 3/1984 | Dillon | 60/528 |
| 4,455,825 | A | * | 6/1984 | Pinto | 60/517 |
| 4,638,633 | A | * | 1/1987 | Otters | 60/518 |
| 4,768,342 | A | * | 9/1988 | Darooka | 60/525 |
| 5,456,076 | A | * | 10/1995 | Zornes | 60/525 |
| 2002/0124561 | A1 | * | 9/2002 | Ban et al. | 60/517 |
| 2007/0209630 | A1 | * | 9/2007 | Hiraya et al. | 123/197.4 |
| 2009/0272111 | A1 | | 11/2009 | Abe et al. | |

FOREIGN PATENT DOCUMENTS

| | | | | |
|---|---|---|---|---|
| JP | 2005-054640 | A | | 3/2005 |
| RU | 2005899 | C1 | * | 1/1994 |
| WO | WO 2007/114087 | A1 | | 10/2007 |

OTHER PUBLICATIONS

International Search Report and Written Opinion from International Parent Application PCT/IB2009/007787.

* cited by examiner

EXTERNAL COMBUSTION ENGINE

BACKGROUND OF THE INVENTION

1. Field of the Invention

The present invention concerns an external combustion engine, such as for example a Stirling engine, which exploits a cycle of isothermal expansion and compression of a thermodynamic fluid, for example air, nitrogen, helium or others, to determine the alternate and cyclical movement of a displacer and a cylinder, so as to entail the rotation of a determinate drive shaft. In particular, the present invention concerns an external combustion engine with a nominal power able to be modulated.

2. Description of Related Art

External combustion engines are known, for example Stirling engines, which exploit a temperature difference caused in a thermodynamic fluid and actuate the cyclical and alternate movement of a displacer and a cylinder.

The displacer and the cylinder are kinematically connected to each other and to a drive shaft, which transmits to the user device the power delivered.

In this type of known engines, it is therefore sufficient to cause a temperature difference in the thermodynamic fluid to start the functioning of the engine.

Although they are silent to run, have low environmental impact, low maintenance and other characteristics, these engines do not allow variations and modulations of their nominal power, and substantially function always at the same capacity.

This limitation has led to such engines being used almost exclusively in applications where a continuous and constant delivery of energy is necessary.

Therefore, an application of this type of known engines for traction or propulsion, in which continuous variations in power are required, has progressively been abandoned.

BRIEF SUMMARY OF THE INVENTION

Purpose of the present invention is to achieve an external combustion engine that can be used effectively for traction or propulsion, even if variations in power are required.

The Applicant has devised, tested and embodied the present invention to overcome the shortcomings of the state of the art and to obtain these and other purposes and advantages.

The present invention is set forth and characterized in the independent claim, while the dependent claims describe other characteristics of the invention or variants to the main inventive idea.

In accordance with the above purpose, an external combustion engine according to the present invention comprises a drive shaft for the transmission of torque delivered, a first cylinder kinematically connected with the drive shaft, a second cylinder kinematically connected with the drive shaft and a thermodynamic circuit fluidly connected to both cylinders, and having at least an expansion chamber and a compression chamber for a heat-carrying fluid, to determine the cyclical movement of the two cylinders.

According to a characteristic feature of the present invention, the first cylinder is mounted on a first support frame and the second cylinder is mounted on a second support frame distinct and constrained movably with respect to the first support frame, so as to be able to vary the kinematic phasing of reciprocal connection of the two cylinders with respect to the drive shaft.

The phasing variation entails different functioning conditions of the two cylinders, thus varying the work capacities of each of the two.

Consequently, the different working capacities defined in the different phasing conditions determine coordinated variations in the torque delivered by the drive shaft.

The engine according to the present invention also comprises movement means, mechanically connected to the first support frame and/or the second support frame, to determine the desired relative movement of the first support frame and the second support frame, and hence the phasing of the second cylinder with respect to the first.

With the present invention we therefore have an external combustion engine in which it is possible, by means of the action of the movement means, to adjust and modulate the power delivered on the drive shaft, varying the position of the cylinders, and hence their reciprocal kinematic phasing.

In this way, the external combustion engine according to the present invention can advantageously also be applied for traction or propulsion of vehicles, in which diverse and continuous variations in the torque delivered are required.

According to a variant, the first support frame and the second support frame are reciprocally pivoted to each other, in correspondence with the axis of rotation of the drive shaft.

In this way we have the possibility of effecting a rotation at least of the first cylinder with respect to the second cylinder, to vary the reciprocal phasing conditions.

According to another variant, the movement means comprise at least a drive member, for example of the electric type, controlled by a position transducer, for example a decoder, and able to make the first support frame and the second support frame rotate by a determinate number of degrees with respect to each other.

According to another variant, the expansion chamber and the compression chamber are associated at least with the second cylinder which thus functions as a displacer, whereas the first cylinder functions as a motion actuator.

According to another variant, the expansion chamber is heated by means of a heater member, for example a burner, a resistance or other, activated by solar energy, by combustion, heat conveyance or other.

According to another variant, the expansion chamber is heated by means of an external heat-carrying fluid, circulating for example in a pipe disposed around the expansion chamber.

According to another variant, the compression chamber is cooled by means of an external heat-carrying fluid.

According to another variant, the compression chamber is associated, in a first part, with the first cylinder and, in a second part, associated with the second cylinder.

According to another variant, the kinematic connection of each cylinder comprises at least a connecting rod or crank, the latter common for both cylinders, keyed to the drive shaft.

According to a variant, the connecting rods of each cylinder are kinematically constrained to the common crank with respect to the same axis of constraint, substantially parallel to the axis of rotation of the crank.

According to another variant, the connecting rod or rods of the first cylinder are constrained to the crank with respect to a relative first axis of constraint, whereas the connecting rod or rods of the second cylinder are constrained to the crank with respect to a relative second axis of constraint, staggered by some degrees with respect to the first axis of constraint.

BRIEF DESCRIPTION OF THE SEVERAL VIEWS OF THE DRAWINGS

These and other characteristics of the present invention will become apparent from the following description of some preferential forms of embodiment, given as a non-restrictive example with reference to the attached drawings wherein.

DETAILED DESCRIPTION OF THE INVENTION

Figure 1:
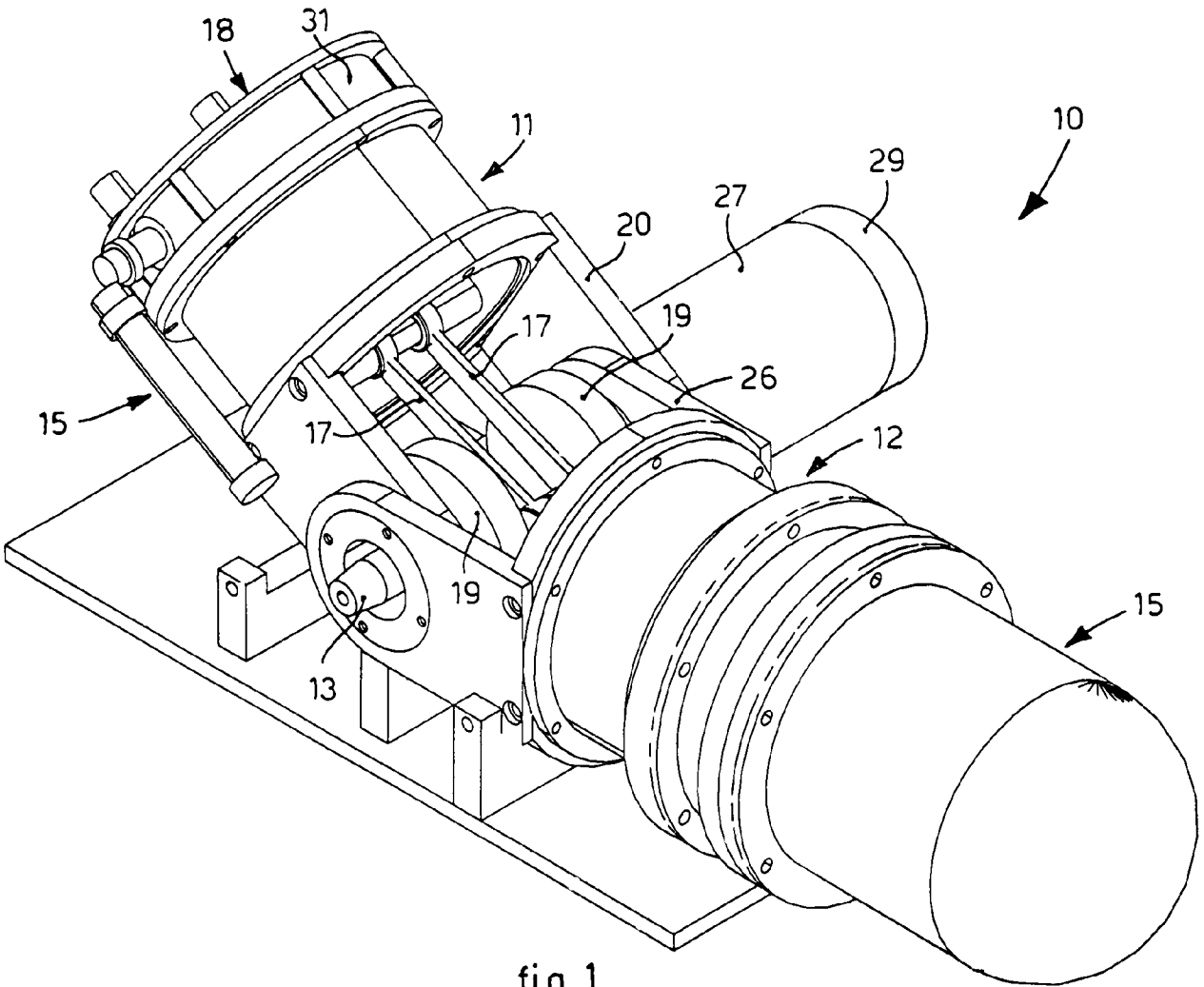
FIG. 1 is a three-dimensional view of an external combustion engine according to a first embodiment of the present invention.

With reference to the attached drawings, an external combustion engine 10 according to the present invention is in this case a Stirling engine with a γ (gamma) configuration, that is, provided with an actuator cylinder 11 and a displacer cylinder 12, both kinematically connected to a drive shaft 13.

The engine 10 also comprises a thermodynamic circuit 15, inside which a heat-carrying fluid flows, in this case air.

Each cylinder 11, 12 is fluidly connected to the thermodynamic circuit 15, so as to be conditioned in movement by said thermodynamic circuit 15.

In particular, the actuator cylinder 11 comprises a first piston 16 sliding linearly inside a first cold chamber 18 of the thermodynamic circuit 15.

The displacer cylinder 12 comprises a second piston 21 sliding alternatively inside a hot chamber 22 and a second cold chamber 23 of the thermodynamic circuit 15.

Figure 4:
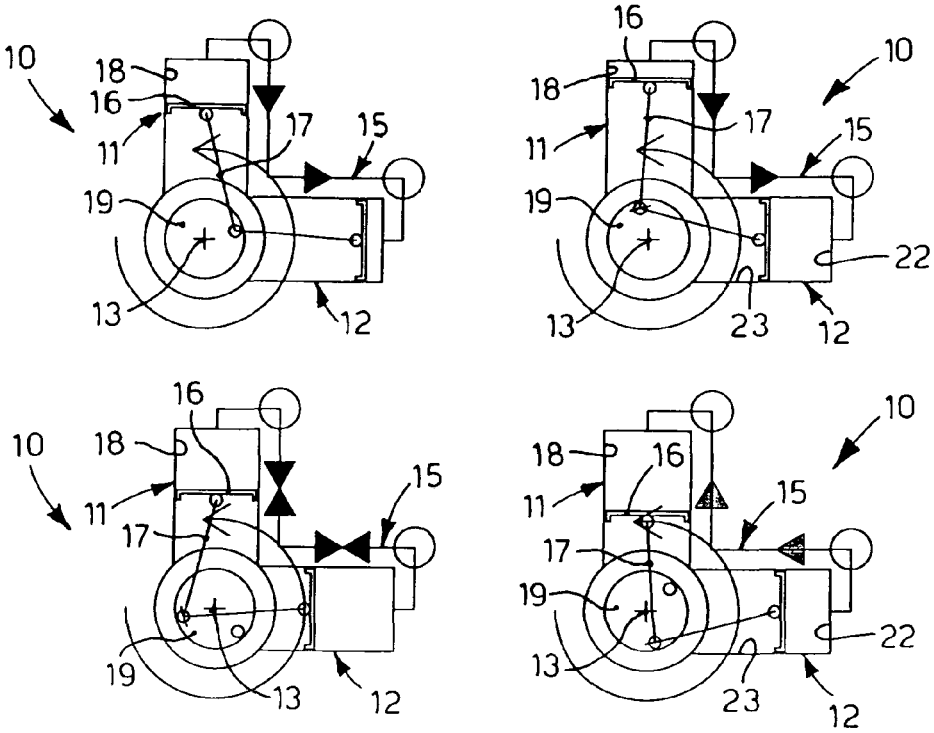
FIG. 4 shows four functioning phases of the external combustion engine in FIG. 1, in a first operating condition.
Figure 5:
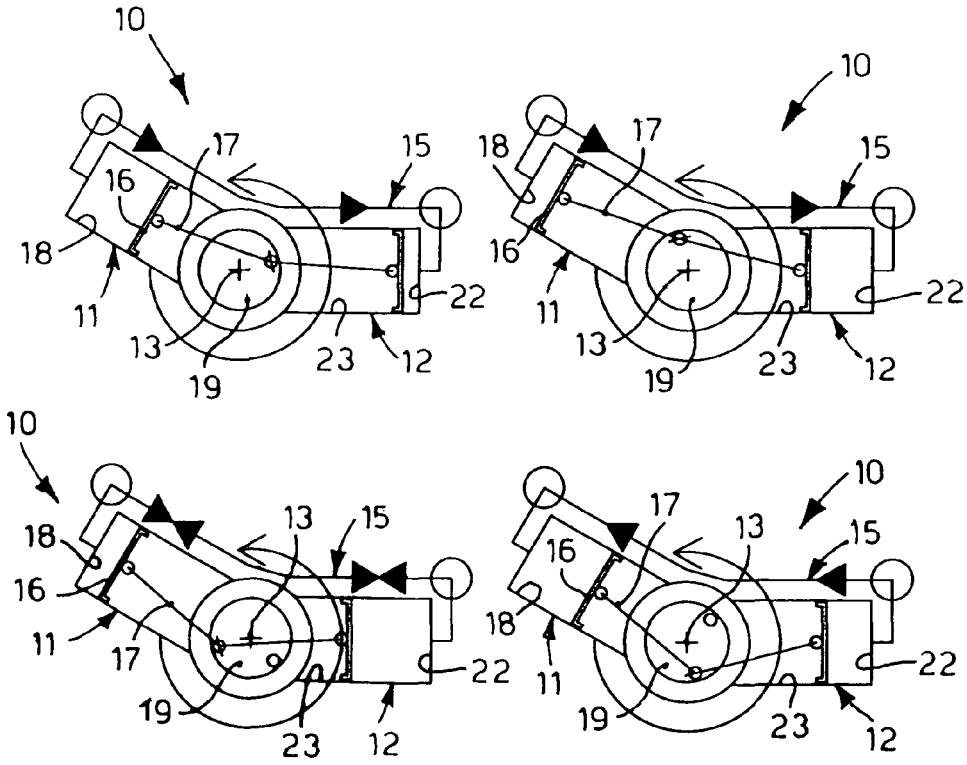
FIG. 5 shows four functioning phases of the external combustion engine in FIG. 1, in a second operating condition.

The cold chambers 18, 23 and the hot chamber 22 are connected by means of connection pipes of a substantially known type and only shown schematically in FIGS. 4 and 5. Advantageously, the connection pipes are at least partly flexible so as to allow the free rotation of the first support frame 20 with respect to the second support frame 26.

Figure 3:
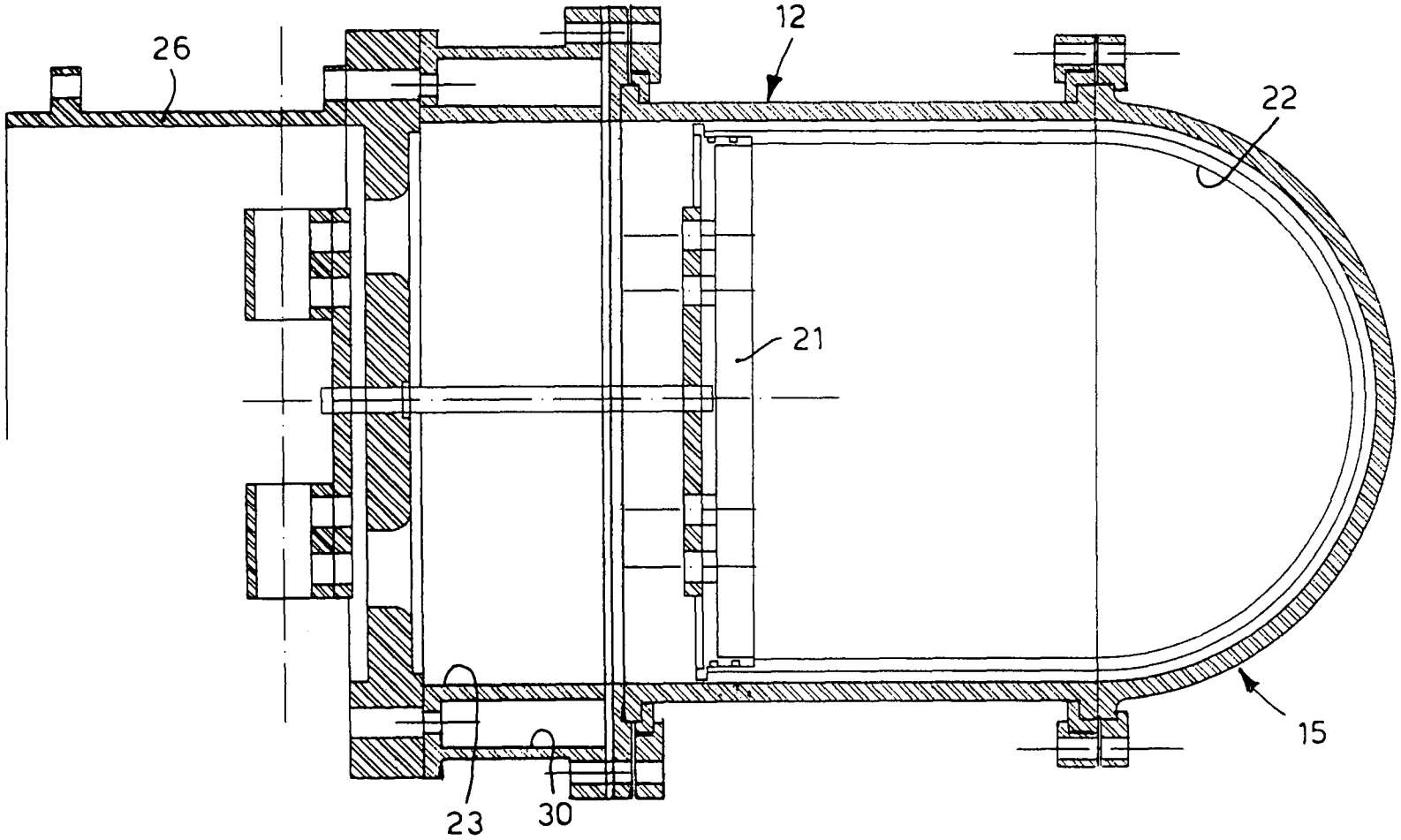
FIG. 3 is a section view of an enlarged detail of the external combustion engine in FIG. 1.

With reference to the section shown in FIG. 3, the hot chamber 22 is before the second piston 21, and relatively high temperatures are reached inside it, for example about 400° C.-500° C.

The second cold chamber 23 is provided on the opposite side to the hot chamber 22 with respect to the second piston 21, and relatively low temperatures are reached inside it, for example about 130° C.-140° C.

The hot chamber 22 is connected to the second cold chamber 23, so as to allow the fluid to flow from one chamber to the other during the steps of isothermal expansion and compression of the fluid, typical of Stirling engines.

In this case, the hot chamber 22 is heated by means of a heating plant that takes energy from one or more heat concentrators, for example a lens, panel, mirror or others, not shown, whereas the second cold chamber 23 comprises externally a cooling pipe 30, in which a cooling fluid circulates, such as for example cold water or other.

In the same way, the first cold chamber 18 also comprises externally a cooling pipe 31, in which a cooling fluid circulates, such as for example cold water or other.

The first piston 16 is kinematically connected to the drive shaft 13 by means of two first connecting rods 17, which are constrained to a crank 19, in turn keyed onto the drive shaft 13.

The second piston 21 is kinematically connected to the drive shaft 13 by means of two second connecting rods 25, which are constrained to a crank 19, in turn keyed onto the drive shaft 13.

Figure 2:
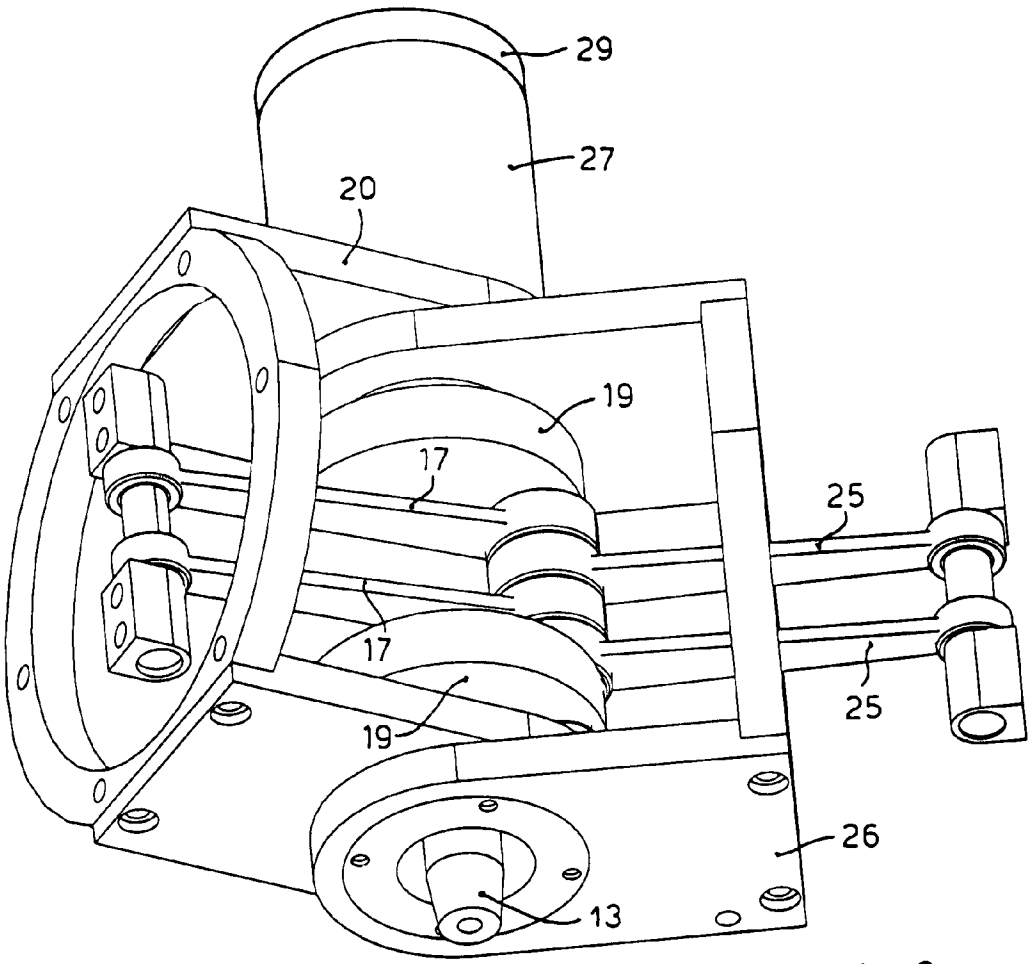
FIG. 2 is a part three-dimensional view of an enlarged detail of the external combustion engine in FIG. 1.

In this case (FIG. 2), the first two connecting rods 17 and the second two connecting rods 25 are connected to the crank 19 by means of a single shaft, not shown in the drawings, with respect to which they are disposed idle and alternating with each other.

According to a variant, the first connecting rods 17 are disposed on the shaft, internal with respect to the second connecting rods 25. Vice versa, the second connecting rods 25 are disposed on the shaft, internal with respect to the first connecting rods 17.

The actuator cylinder 11 is mounted on a first support frame 20.

The displacer cylinder 12 is mounted on a second support frame 26, hinged to the first frame 20 in correspondence with a median axis of rotation of the drive shaft 13.

In this case, the first support frame 20 and the second support frame 26 are substantially conformed as a fork and are hinged to each other in a substantially staggered condition.

According to a variant, the first support frame 20 is hinged in a completely internal or external condition with respect to the support frame 26.

The engine 10 according to the present invention also comprises an electric actuator 27 mounted in a coaxial position to the drive shaft 13 and constrained to the first frame 20 and to the second frame 26.

In this way, the electric motor allows the first frame 20 to rotate with respect to the second frame 26.

This rotation determines an angular variation of the reciprocal position of the two cylinders 11 and 12, so that they can be selectively positioned between a first functioning condition at maximum capacity (FIG. 4), in which the relative kinematic connections are reciprocally in a substantially optimum phasing, and a plurality of second operating conditions (FIG. 5) in which the variation in position of the actuator cylinder 11 determines an equal number of coordinated variations in the phasing condition of the kinematic connections.

In the operating conditions shown in FIGS. 4 and 5, the actuator cylinder 11, in the first condition, is at about 70° from the displacer cylinder 12, while in the second condition shown it is at about 160° from the displacer cylinder 12.

This variation in phasing determines the variation in the work capacity of the actuator cylinder 11, thus also varying the torque transmitted to the drive shaft 13.

With the engine 10, by varying the reciprocal angular position of the two support frames 20, 26, and hence of the respective cylinders 11, 12, it is possible to vary, in a coordinated manner, the power delivered.

In this case, a position transducer 29, such as an encoder or a linear potentiometer, is associated with the electric actuator 27 and is able to detect at least the angular position of the actuator cylinder 11.

In this embodiment, providing a connection to a command and control unit, it is possible to vary as desired, and also continuously, the angular position of the actuator cylinder 11 with respect to the displacer cylinder 12, so as to vary as desired the power delivered.

Figure 6:
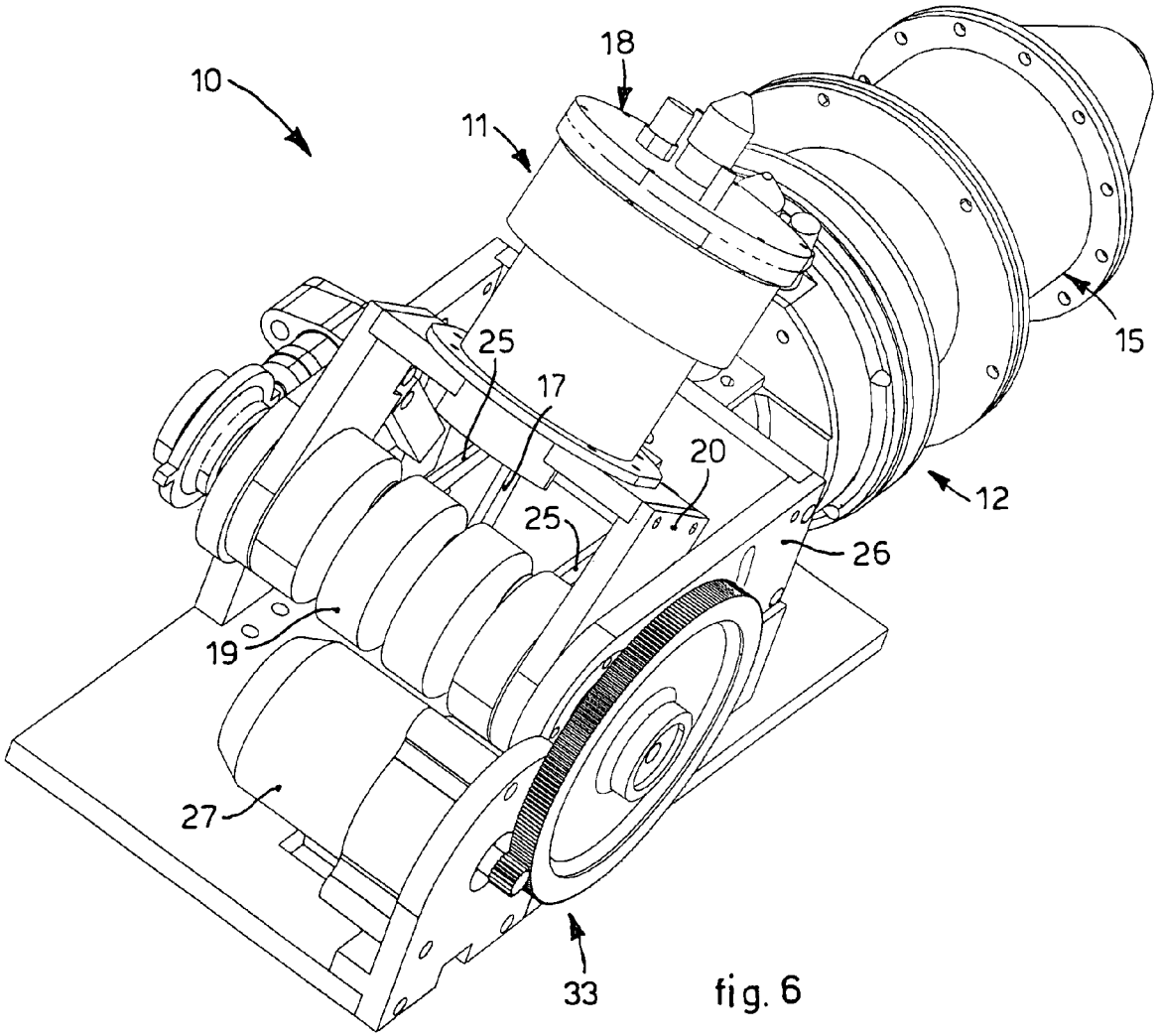
FIG. 6 is a three-dimensional view of a second embodiment of the external combustion engine according to the present invention.
Figure 7:
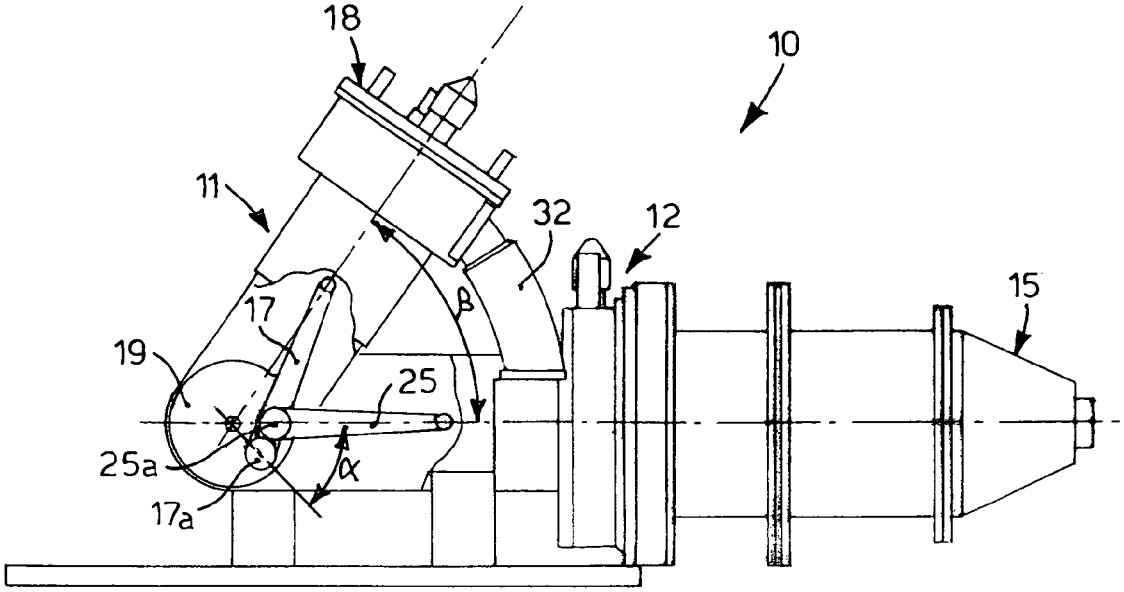
FIG. 7 shows a schematic side view, partly in section, of the external combustion engine in FIG. 6 in a first operating condition.
Figure 8:
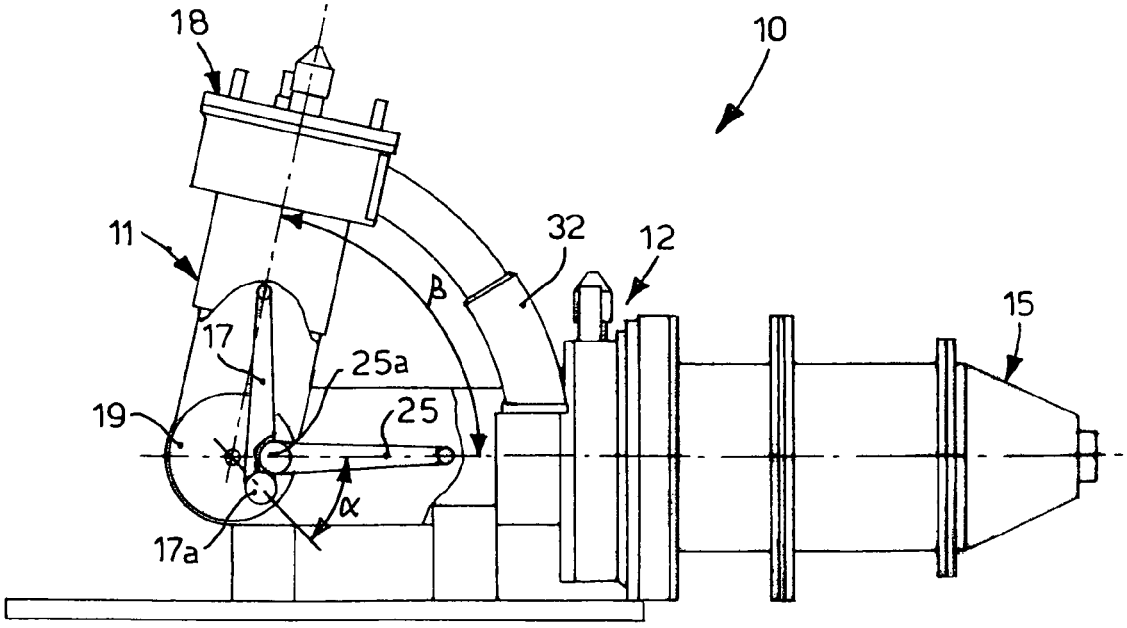
FIG. 8 shows a schematic side view, partly in section, of the external combustion engine in FIG. 6 in a second operating condition.

In the embodiment shown in FIGS. 6, 7 and 8, the actuator cylinder 11 always defines an acute angle with the displacer cylinder 12, both in the first functioning condition and also in the second operating conditions.

In this embodiment too, the variation in position of the actuator cylinder 11 determines an equal number of variations in the phasing of the kinematic connections and therefore of the work capacity and torque.

In particular, the first connecting rod 17 and the two second connecting rods 25 are connected to the crank 19 by means of specific shafts 17*a* and 25*a*.

The two shafts 17*a* and 25*a* are angularly staggered with respect to each other by a determinate constant angle α, which allows to keep the relative angle β between the two cylinders 11 and 12 at less than about 90°.

This solution mainly allows to render the engine 10 generally more compact, reducing the bulk and hence increasing the practical applications thereof.

Furthermore, a close-up condition of the two cylinders 11, 12 allows to reduce the length of the hydraulic connection pipes between the cold chambers 18, 23 and the hot chamber 22.

In the solution shown, the hydraulic connection pipes are advantageously cabled inside a telescopic casing 32, suitable to follow the movement of the actuator cylinder 11 with respect to the displacer cylinder 12.

This solution allows to reduce the length of the hydraulic connection pipes, which gives the advantage of reducing possible losses of load and an improved and more orderly disposition of the pipes.

In the solution shown in FIG. 6, unlike the previous embodiment described, the electric actuator 27 is operatively connected to the first frame 20 by means of a gear kinematism 33.

In this solution it is also possible to reduce the overall bulk of the engine laterally.

It is clear, however, that modifications and/or additions of parts may be made to the engine 10 as described heretofore, without departing from the field and scope of the present invention.

For example, it comes within the field of the present invention to provide that the first support frame 20 and the second support frame 26 are constrained to each other movably through reciprocal linear sliding by means of guides and sliding blocks.

According to a variant, instead of the electric actuator 27 a mechanical movement may be provided, for example of the type with a nut/worm screw.

It also comes within the field of the present invention to provide that the hinging of the first support frame 20 and the second support frame 26 is achieved independently of the axis of rotation of the drive shaft 13.

It is also clear that, although the present invention has been described with reference to some specific examples, a person of skill in the art shall certainly be able to achieve many other equivalent forms of external combustion engine, having the characteristics as set forth in the claims and hence all coming within the field of protection defined thereby.

The invention claimed is:

1. A Stirling external combustion engine with a γ configuration comprising a drive shaft, a first actuator cylinder kinematically connected to said drive shaft, a second displacer cylinder kinematically connected to said drive shaft, and a thermodynamic circuit fluidly connected to both said actuator and displacer cylinders, and having at least an expansion chamber and a compression chamber for a heat-carrying fluid, in order to determine the cyclic movement of said first actuator cylinder and said second displacer cylinder, wherein said first actuator cylinder is mounted on a first support frame and said second displacer cylinder is mounted on a second support frame, distinct from and constrained in a mobile manner to the first support frame, wherein said first support frame and said second support frame are reciprocally hinged to each other, in correspondence with an axis of rotation of said drive shaft, movement means being mechanically connected to said first support frame and/or said second support frame, in order to determine the desired relative movement of said first support frame and said second support frame and to vary the reciprocal kinematic connection phasing of said two actuator and displacer cylinders with respect to said drive shaft.

2. The external combustion engine as in claim 1, wherein said movement means comprise at least a drive member able to move said first support frame and said second support frame relatively to each other.

3. The external combustion engine as in claim 1, wherein said expansion chamber and said compression chamber are associated at least with said second displacer cylinder.

4. The external combustion engine as in claim 1, comprising at least a heating member operatively associated with said expansion chamber, in order to effect the heating thereof.

5. The external combustion engine as in claim 1, comprising at least a pipe disposed around said expansion chamber inside which pipe a heat-carrying fluid is able to flow.

6. The external combustion engine as in claim 1, comprising at least a cooling pipe disposed around said compression chamber inside which pipe a heat-carrying fluid is able to flow.

7. The external combustion engine as in claim 1, wherein said compression chamber, in a first part, is associated with said first actuator cylinder and, in a second part, is associated with said second displacer cylinder.

8. The external combustion engine as in claim 1, wherein the kinematic connection of each of the actuator and displacer cylinders comprises at least a relative connecting rod and a crank common for both of the actuator and displacer cylinders keyed to said drive shaft.

9. The external combustion engine as in claim 8, wherein the connecting rods of each of the actuator and displacer cylinders are kinematically constrained to the common crank with respect to the same axis of constraint, substantially parallel to the axis of rotation of said crank.

10. The external combustion engine as in claim 8, wherein the connecting rod or rods of the first actuator cylinder are constrained to the crank with respect to a relative first axis of constraint defined by a first shaft, whereas the connecting rod or rods of the second displacer cylinder are constrained to the crank with respect to a relative second axis of constraint defined by a second shaft, angularly staggered with respect to the first axis of constraint by a staggering angle α configured to keep a relative angle β between the actuator cylinder and the displacer cylinder at less than about 90°.

11. A Stirling external combustion engine with a γ configuration comprising a drive shaft, a first actuator cylinder kinematically connected to said drive shaft, a second displacer cylinder kinematically connected to said drive shaft, and a thermodynamic circuit fluidly connected to both said actuator and displacer cylinders, and having at least an expansion chamber and a compression chamber for a heat-carrying fluid, in order to determine the cyclic movement of said first actuator cylinder and said second displacer cylinder, wherein said first actuator cylinder is mounted on a first support frame and said second displacer cylinder is mounted on a second support frame, wherein said first support frame and said second support frame are reciprocally hinged to each other, in correspondence with an axis of rotation of said drive shaft, wherein the kinematic connection of each of the actuator and the displacer cylinder comprises at least a relative connecting rod and a crank common for both of the actuator and displacer cylinders keyed to said drive shaft, and wherein the connecting rod or rods of the first actuator cylinder are constrained to the crank with respect to a relative first axis of constraint defined by a first shaft, whereas the connecting rod or rods of the second displacer cylinder are constrained to the crank with respect to a relative second axis of constraint defined by a second shaft, angularly staggered with respect to the first axis of constraint by a staggering angle $\alpha$ configured to keep a relative angle $\beta$ between the actuator cylinder and the displacer cylinder at less than about 90°.

12. The external combustion engine as in claim 8, comprising two first connecting rods kinematically connecting the first actuator cylinder to the drive shaft and two second connecting rods kinematically connecting the second displacer cylinder to the drive shaft, said two first connecting rods and said two second connecting rods being constrained to the common crank in turn keyed onto the drive shaft.

13. The external combustion engine as in claim 12, wherein the first two connecting rods and the second two connecting rods are connected to the common crank by one single shaft with respect to which they are disposed idle and alternating with each other.

14. The external combustion engine as in claim 12, wherein the first connecting rods are disposed on the shaft, internal with respect to the second connecting rods.

15. The external combustion engine as in claim 12, wherein the second connecting rods are disposed on the shaft, internal with respect to the first connecting rods.

16. The external combustion engine as in claim 1, comprising an electric actuator mounted in a coaxial position to the drive shaft and constrained to the first frame and the second frame.

17. The external combustion engine as in claim 16, wherein the electric actuator is operatively connected to the first frame by a gear kinematism.

18. The external combustion engine as in claim 16, comprising a position transducer associated with the electric actuator and configured to detect at least the angular position of the first actuator cylinder.

19. The external combustion engine as in claim 1, comprising connection pipes connecting the at least one expansion chamber and the compression chamber, said connection pipes being cabled inside a telescopic casing.

* * * * *